US009051651B2

(12) United States Patent
Veronesi et al.

(10) Patent No.: US 9,051,651 B2
(45) Date of Patent: Jun. 9, 2015

(54) ELEVATOR LOAD BEARING MEMBER HAVING A CONVERSION COATING ON TENSION MEMBER

(75) Inventors: William A. Veronesi, Hartford, CT (US); Mark R. Jaworowski, Glastonbury, CT (US); Hugh J. O'Donnell, Longmeadow, MA (US)

(73) Assignee: Otis Elevator Company, Farmington, CT (US)

( * ) Notice: Subject to any disclaimer, the term of this patent is extended or adjusted under 35 U.S.C. 154(b) by 2002 days.

(21) Appl. No.: 12/090,260

(22) PCT Filed: Nov. 14, 2005

(86) PCT No.: PCT/US2005/041408

§ 371 (c)(1),
(2), (4) Date: Apr. 15, 2008

(87) PCT Pub. No.: WO2007/055701

PCT Pub. Date: May 18, 2007

(65) Prior Publication Data

US 2008/0277206 A1 Nov. 13, 2008

(51) Int. Cl.
*B66B 11/04* (2006.01)
*B66B 11/00* (2006.01)
(Continued)

(52) U.S. Cl.
CPC . *C23C 22/00* (2013.01); *B66B 7/06* (2013.01); *B66B 7/062* (2013.01); *D07B 1/0666* (2013.01); *D07B 1/162* (2013.01); *D07B 2201/1008* (2013.01); *D07B 2201/1036* (2013.01);
(Continued)

(58) Field of Classification Search
CPC ..... D07B 2501/2007; D07B 2250/3064
USPC ..... 187/251, 254, 255, 266; 57/221; 428/472.2, 472.3
IPC .... B66B 11/04, 11/08, 7/06; D02G 3/36; D07B 1/16
See application file for complete search history.

(56) References Cited

U.S. PATENT DOCUMENTS 3,404,046 A * 10/1968 Russell et al. ..... 148/254
3,595,985 A * 7/1971 Zelley ..... 428/592
(Continued)

FOREIGN PATENT DOCUMENTS

EP 257667 A1 * 3/1988 ..... B29C 65/48
EP 0257667 B1 10/1991
(Continued)

OTHER PUBLICATIONS

Molkow M: "Wire Ropes and New Suspension Means Design, Use, Safety, Handling and Care, Discard Criteria", Lift Report, VFZ Verlag, Dortmunt, DE, vol. 27, No. 5, Sep. 1, 2001, pp. 14, 16, 18-20, XP001092527, ISSN: 0341-3721.
(Continued)

*Primary Examiner* — William A Rivera
*Assistant Examiner* — Stefan Kruer
(74) *Attorney, Agent, or Firm* — Carlson, Gaskey & Olds, P.C.

(57) ABSTRACT

A load bearing member (22) useful in an elevator system (10) includes at least one elongated tension member (36), a conversion coating (46) on the elongated tension member (36), and a polymer jacket (34) at least partially surrounding the coated elongated tension member (36). In one example, the conversion coating (46) includes at least one of an oxide, a phosphate, or a chromate.

27 Claims, 2 Drawing Sheets

(51) Int. Cl.

| | |
|---|---|
| ***D07B 1/16*** | (2006.01) |
| ***B32B 15/08*** | (2006.01) |
| ***C23C 22/00*** | (2006.01) |
| ***D07B 1/06*** | (2006.01) |
| *B66B 7/06* | (2006.01) |
| *B66B 11/08* | (2006.01) |

(52) U.S. Cl.

CPC ... *D07B2201/104* (2013.01); *D07B 2201/2042* (2013.01); *D07B 2201/2043* (2013.01); *D07B 2201/2047* (2013.01); *D07B 2201/2087* (2013.01); *D07B 2205/30* (2013.01); *D07B 2205/3064* (2013.01); *D07B 2501/2007* (2013.01)

(56) References Cited

U.S. PATENT DOCUMENTS

| | | | | | |
|---|---|---|---|---|---|
| 3,706,604 | A | * | 12/1972 | Plaxton | 428/472.2 |
| 3,899,365 | A | * | 8/1975 | Guy | 148/250 |
| 3,996,074 | A | | 12/1976 | Rakestraw et al. | |
| 4,037,019 | A | * | 7/1977 | Steger | 428/469 |
| 4,490,527 | A | | 12/1984 | Schiehser et al. | |
| 4,554,219 | A | * | 11/1985 | Gamblin | 428/667 |
| 4,644,029 | A | | 2/1987 | Cable et al. | |
| 4,725,491 | A | * | 2/1988 | Goldfein | 428/312.4 |
| 5,971,658 | A | | 10/1999 | Pramono et al. | |
| 6,106,741 | A | * | 8/2000 | Heimann et al. | 252/389.3 |
| 6,295,799 | B1 | | 10/2001 | Baranda | |
| 6,500,558 | B2 | * | 12/2002 | Yamaguchi | 428/469 |
| 6,695,931 | B1 | * | 2/2004 | Ravenscroft et al. | 148/276 |
| 6,719,852 | B2 | * | 4/2004 | Oshima et al. | 148/243 |
| 6,835,460 | B2 | * | 12/2004 | Cuyler et al. | 428/469 |
| 2003/0104228 | A1 | | 6/2003 | Boulos | |
| 2003/0150167 | A1 | | 8/2003 | Bourgois et al. | |
| 2004/0126611 | A1 | * | 7/2004 | Gonnissen et al. | 428/626 |

FOREIGN PATENT DOCUMENTS

| | | | | | |
|---|---|---|---|---|---|
| JP | 62148530 | A | | 7/1987 | |
| JP | 06143489 | A | * | 5/1994 | B32B 15/08 |
| JP | 06173020 | A | * | 6/1994 | C23C 22/00 |
| JP | 7324288 | | | 12/1995 | |
| WO | WO00/23505 | A1 | | 4/2000 | |
| WO | WO0186100 | | | 11/2001 | |
| WO | WO02061201 | | | 8/2002 | |
| WO | WO2004076327 | | | 9/2004 | |

OTHER PUBLICATIONS

International Preliminary Report on Patentability dated May 22, 2008.

Search Report PCT/US05/41408, mailed Aug. 28, 2006.

* cited by examiner

ELEVATOR LOAD BEARING MEMBER HAVING A CONVERSION COATING ON TENSION MEMBER

1. FIELD OF THE INVENTION

This invention generally relates to load bearing members for use in elevator systems. More particularly, this invention relates to load bearing members that include at least one tension member and an outer polymer jacket.

2. BACKGROUND OF THE INVENTION

Elevator systems are widely known and used. Typical arrangements include an elevator cab that moves between landings in a building, for example, to transport passengers or cargo between different building levels. A motorized elevator machine moves a rope or belt assembly, which typically supports the weight of the cab, and moves the cab through a hoistway.

The elevator machine includes a machine shaft that is selectively rotationally driven by a motor. The machine shaft typically supports a sheave that rotates with the machine shaft. The ropes or belts are tracked through the sheave such that the elevator machine rotates the sheave in one direction to lower the cab and rotates the sheave in an opposite direction to raise the cab.

A rope or belt typically includes one or more tension members to support the weight of the elevator cab. These tension members may be encapsulated in a polymer jacket. One type of tension member comprises steel strands with a polymer jacket. The jacket surrounds the tension members and provides traction between the rope or belt and the sheave.

Conventional jacket application processes leave portions of the cords uncovered by the jacket material. One known technique includes depositing a zinc coating on the steel tension members to protect the exposed portions from corrosion that may result from exposure to the environment in a hoistway.

One disadvantage of typical jacketed ropes and belts may be insufficient adhesion between the polymer jacket and the tension members. The adhesion provides a "pull-out" strength to maintain a desired alignment of the tension members and the jacket. The adhesion also is responsible for transferring the weight of the elevator cab from the jacket to the steel cords. If the weight is not effectively transferred from the weaker jacket material to the stronger steel material, the jacket may be subjected to overstressing. The use of a zinc coating on the steel as mentioned above may further impair a desired level of adhesion.

Another disadvantage of typical ropes and belts may be frictional wear between the steel strands. As the rope or belt bends over a sheave, for example, the steel strands of a tension member may slide relative to each other and rub together. Repeated sliding may subject the steel strands to undesirable wear over a period of time. Conventional zinc coatings do little to reduce this problem.

There is a need for a rope or belt assembly that has improved adhesion between the tension members and the jacket. This invention addresses that need and provides enhanced capabilities while avoiding the shortcomings and drawbacks of the prior art.

SUMMARY OF THE INVENTION

An exemplary load bearing member useful in an elevator system includes at least one elongated tension member, and a conversion coating on the elongated tension member. Some examples include a polymer jacket at least partially surrounding the elongated tension member. In one example, the conversion coating includes at least one of an oxide, a phosphate, or a chromate.

An example method of making a load bearing member includes coating at least one elongated tension member with a conversion coating. One example method includes at least partially surrounding the coated tension member with a polymer jacket. One example includes chemically bonding the conversion coating to the elongated tension member and mechanically bonding the conversion coating to the polymer jacket.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
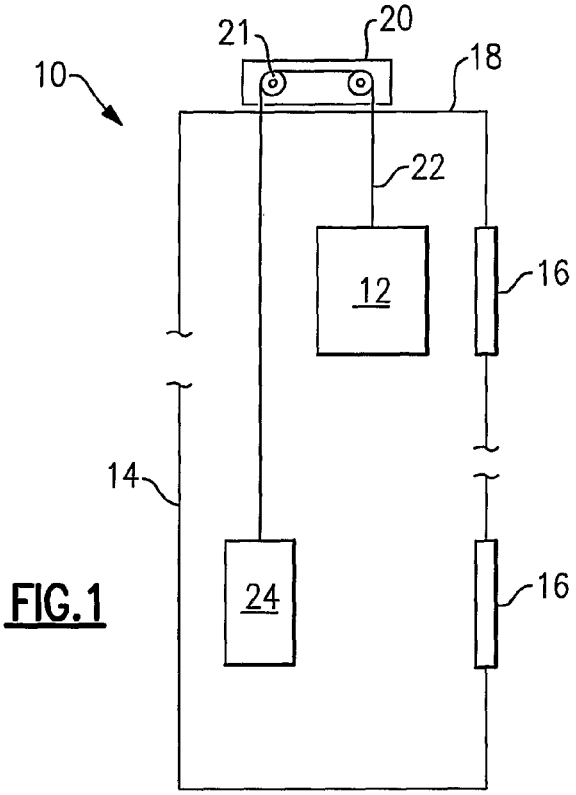
FIG. 1 schematically shows selected portions of an example elevator system.

FIG. 1 schematically shows selected portions of an example elevator system 10 that includes an elevator cab 12 that moves in a hoistway 14 between landings 16 in a known manner. In the example shown, a platform 18 above the elevator cab 12 supports an elevator machine 20. The elevator machine 20 includes a sheave 21 for moving a load bearing member 22, such as an elevator rope or belt, to move the cab 12 and a counterweight 24 in a known manner up and down in the hoistway 14. The load bearing member 22 supports the weight of the elevator cab 12 and counterweight 24.

Figure 2:
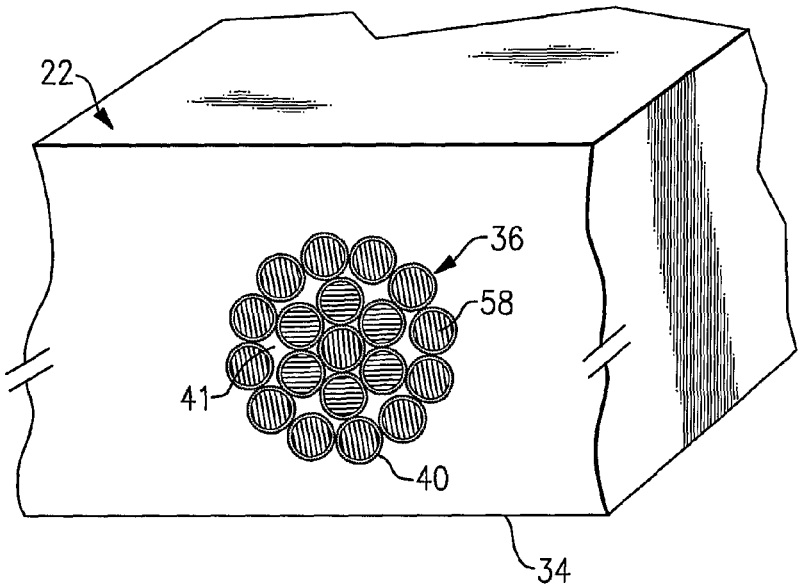
FIG. 2 schematically shows selected portions of an example load bearing member.
Figure 3:
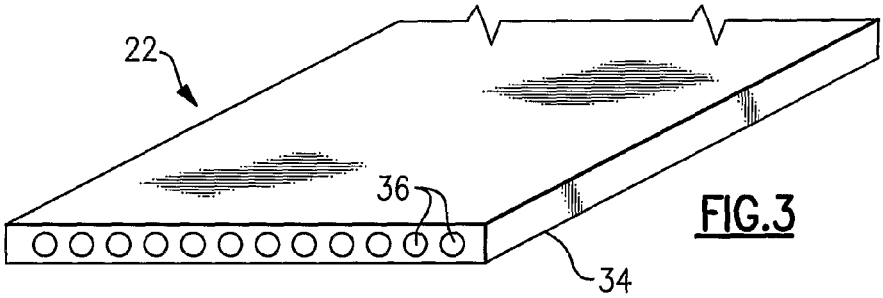
FIG. 3 schematically shows a cross-sectional view of an example strand of a tension member having a conversion coating.

FIG. 2 shows selected portions of an example load bearing member 22 that includes a polymer jacket 34, such as polyurethane or another polymer, which at least partially surrounds a tension member 36. The illustration shows one tension member but, as known, the load bearing member 22 may comprise a plurality of tension members 36 (FIG. 3). One example load bearing member 22 is a coated steel rope. Another example load bearing member 22 is a flat coated steel belt.

In the example shown, the tension member 36 includes a plurality of strands 38, such as steel strands. Groups of strands 38 are bundled together to form cords 40. In the illustrated example, the tension member 36 includes one cord 40.

The circular cross-sections of the strands 38 result in space 41 between the strands 38. In the illustrated example, the material of the polymer jacket 34 at least partially penetrates and fills some of the space 41 during an extrusion or other process used to form the polymer jacket 34, for example.

Figure 4:
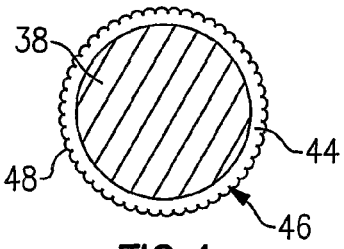
FIG. 4 schematically shows a cross-sectional view of a second embodiment of an example strand of a tension member having a conversion coating and a second coating.

FIG. 4 shows selected features of an example strand 38 made of steel and having an outer surface 44. In the example shown, a conversion coating 46 is chemically bonded to the outer surface 44. That is, the example conversion coating 46 is formed on the outer surface 44 through chemical reactions rather than by mechanical deposition and is chemically bonded to the strand 38. In one example, each strand 38 of the cord 40 (FIG. 2) is individually coated with the conversion coating 46 before being wound into a cord 40.

In one example, the conversion coating 46 includes a phosphate coating having a selected amount of the chemical element manganese. In one example, the manganese provides an advantageous crystallographic structure for mechanical interlocking with the polymer jacket 34, as will be discussed below. In another example, the conversion coating 46 includes a phosphate coating having at least one of zinc, nickel, or chrome, or iron to provide an advantageous crystallographic structure. In a further example, the coating 46 includes at least one of manganese phosphate, nickel phosphate, chromium phosphate, zinc phosphate, or iron phosphate.

In another example, the conversion coating 46 includes at least one of a chromium coating (hexavalent or trivalent) or a black iron oxide coating to provide an advantageous crystallographic structure with additional corrosion inhibition.

In one example, the conversion coating 46 is sealed by a known technique to fill at least a portion of any pores in the conversion coating 46. In another example, the conversion coating 46 is left unsealed.

In one example, the conversion coating 46 inhibits corrosion of the strand 38, promotes adhesion between the strand 38 and the polymer jacket 34, and provides lubricity between strands 38 that are wound together to form the cord 40.

In another example, the conversion coating 46 includes forming a phosphate coating using a known conversion coating technique such as chemical immersion, chemical spraying, or another process. The example phosphate includes the chemical element phosphorous bonded to oxygen, which forms an oxide. An active substance such as phosphoric acid reacts with the outer surface 44 of the strand 38 to form phosphorous oxide. The resulting phosphate coating is at least partially chemically bonded to the outer surface portion 44 and passivates the outer surface 44 to inhibit corrosion of the strand 38.

In the illustrated example, the phosphate coating provides lubricity and wear resistance between the strands 38 of a cord 40. The strands 38 may slide relative to each other in use when the load bearing member 24 wraps around the sheave 21 of a cord 40. For example, phosphate is known to be a solid lubricant and allows the strands 38 to slide against each other with less friction compared to previously used zinc-coated strands. Chemically bonding the phosphate coating to the outer surface 44 of the strand 38 provides the benefit of preventing the phosphate coating from easily delaminating, as may otherwise occur with a coating that is not chemically bonded. If a portion of a coating delaminates, the delaminated particle may act as an abrasive particle and accelerate wear between strands, for example.

In the example shown, the phosphate conversion coating 46 has an irregularly-shaped external surface 48. The irregularly-shaped surface 48 results from the crystallographic structure of the conversion coating 46. Such a surface facilitates mechanically locking the polymer jacket 34 to the tension member 36 to form a strong bond. The chemical bonding between the conversion coating 46 and the strands 38 along with the mechanical locking between the conversion coating 46 and the polymer jacket 34 provide the benefit of strong adhesion between the polymer jacket 34 and the tension member 36.

In one example, strong adhesion promotes efficient transfer of the weight of the elevator cab 12 from the polymer jacket 34 to the cords 40 and strands 38 of the tension member 36, as the jacket 34 is under compression between the tension member 36 and the sheave 21.

The strong adhesion also provides latitude in selecting the type of polymer for the polymer jacket 34. In one example, the polymer jacket 34 includes either a polyurethane variation or a different type of polymer than polyurethane. Without the conversion coating 46, the jacket material had to have selected properties to achieve sufficient bonding between the jacket 34 and the tension member 36. This limited the choices for jacket materials. With the superior adhesion provided by the conversion coating 46, a wider variety of materials are suitable candidates for forming the jacket. Another benefit associated with more freedom in choosing a jacket material is that the choice may be dictated, at least in part, by a desire to facilitate better molding when forming the jacket. Given this description, those skilled in the art will be able to select appropriate coating components and jacket materials to meet the needs of their particular situation.

Figure 5:
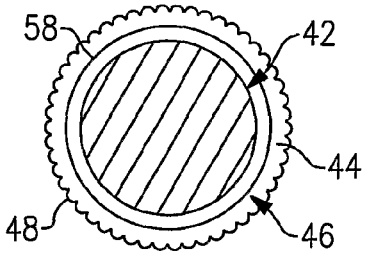
FIG. 5 schematically shows a cross-sectional view of selected portions of another example load bearing member.

FIG. 5 shows selected features of a second embodiment of an example strand 38 that includes an underlayer coating 58 below the conversion coating 46. In one example, the underlayer coating 58 includes a zinc coating for additional corrosion protection of the strand 38. The example underlayer coating 58 is deposited in a spray, dip, or other process and provides a sacrificial corrosion coating while the conversion coating 46 provides a passivated coating.

Figure 6:
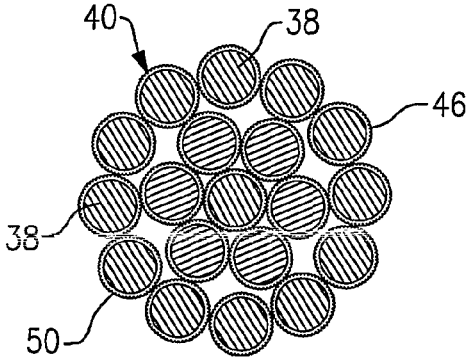
FIG. 6 schematically shows a cross-sectional view of an example cord of a tension member.

In the example shown in FIG. 6, the cord 40 is coated with the conversion coating 46 after the cord is formed rather than each individual strand 38 being coated. In the illustrated example, the spaces 41 between the strands 38 are large enough to permit at least partial penetration of the conversion coating 46 such that the conversion coating 46 at least partially coats strands 38 towards the center of the cord 40 rather than only near the periphery 50. In another example, the extent to which the strands 38 towards the center of the cord 40 are coated depends on the type of conversion coating process used, the type and viscosity of the conversion coating chemicals, and the size of the spaces 41 between the strands 38. Given this description, those skilled in the art will be able to select appropriate parameters to meet the needs of their particular situation.

Figure 7:
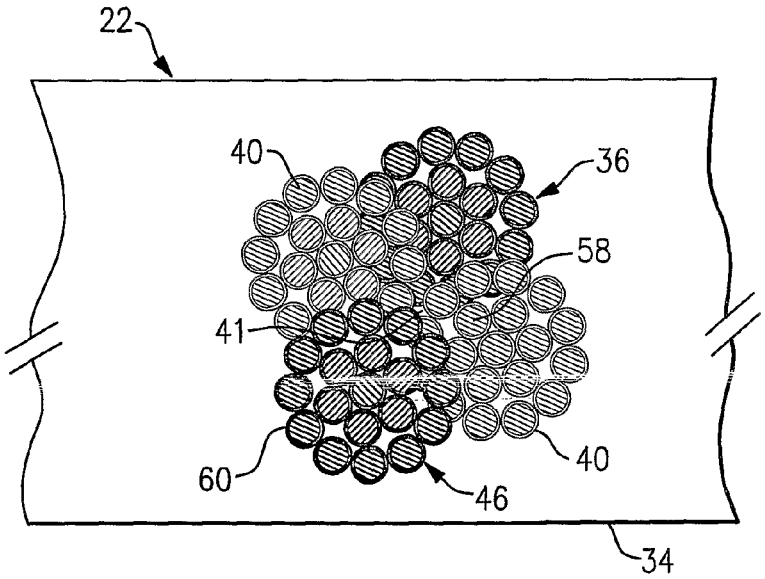
FIG. 7 shows selected portions of another embodiment of an example load bearing member having a tension member that includes a plurality of cords wound together.

FIG. 7 shows selected portions of another embodiment of an example load bearing member 22 having a tension member 36 that includes a plurality of cords 40 wound together. The illustration shows one tension member 36 but, as known, the load bearing member 22 may comprise a plurality of tension members 36. In the illustrated example, the entire tension member 36 is coated with the conversion coating 46 rather than each individual strand 38 or each individual cord 40 being coated before they are wound together to form the tension member 36. The example conversion coating 46 is formed on a periphery 60 of the tension member 36 through chemical reactions rather than by mechanical deposition, as explained above. Depending on the needs of a particular situation, those skilled in the art who have the benefit of this description will be able to select whether to coat individual strands 38, individual cords 40 or an entire tension member 36.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A load bearing member for use in an elevator system comprising:

at least one elongated steel tension member; and a conversion coating on the elongated steel tension member, the conversion coating including at least one of chromium phosphate, black iron oxide, or nickel phosphate.

2. The load bearing member as recited in claim 1, including a polymer jacket at least partially surrounding the elongated tension member.

3. The load bearing member as recited in claim 2, wherein the elongated steel tension member includes a strand having an outer surface, and the conversion coating is chemically bonded to the outer surface and at least partially mechanically bonded to the polymer jacket.

4. The load bearing member as recited in claim 3, including a plurality of steel strands and the conversion coating is at least partially between the steel strands.

5. The load bearing member as recited in claim 2, wherein the polymer jacket includes polyurethane.

6. The load bearing member as recited in claim 2, wherein the conversion coating is chemically bonded to the elongated steel tension member and at least partially mechanically bonded to the polymer jacket.

7. The load bearing member as recited in claim 2, wherein the elongated steel tension member includes a cord having a plurality of wound strands each having an outer surface, and the conversion coating is chemically bonded to at least a portion of the outer surfaces and at least partially mechanically bonded to the polymer jacket.

8. The load bearing member as recited in claim 2, wherein the conversion coating includes an irregular-shaped surface at least partially mechanically bonded to the polymer jacket.

9. The load bearing member as recited in claim 1, including a zinc coating below the conversion coating.

10. The load bearing member as recited in claim 1, wherein the conversion coating includes the chromium phosphate.

11. The load bearing member as recited in claim 1, wherein the conversion coating includes the nickel phosphate.

12. The load bearing member as recited in claim 1, wherein the conversion coating includes the black iron oxide.

13. A method of making a load bearing member for an elevator system comprising:

coating an elongated steel tension member with a conversion coating, the conversion coating including at least one of chromium phosphate, black iron oxide, or nickel phosphate.

14. The method as recited in claim 13, including at least partially surrounding the coated elongated steel tension member with a polymer jacket.

15. The method as recited in claim 14, including mechanically bonding the conversion coating and the polymer jacket together.

16. The method as recited in claim 13, including depositing a zinc underlayer coating prior to conversion coating.

17. The method as recited in claim 13, including chemically bonding the conversion coating to the elongated steel tension member.

18. The method as recited in claim 13, including forming the elongated steel tension member from a plurality of strands and forming the conversion coating at least partially between the plurality of strands.

19. The method as recited in claim 13, including forming the elongated steel tension member from at least one cord that includes a plurality of strands and forming the conversion coating on the at least one cord.

20. The method as recited in claim 13, wherein the conversion coating includes the chromium phosphate.

21. The method as recited in claim 13, wherein the conversion coating includes the nickel phosphate.

22. The method as recited in claim 13, wherein the conversion coating includes the black iron oxide.

23. A load bearing member for use in an elevator system comprising:

at least one elongated steel tension member;

a conversion coating on the elongated steel tension member, the conversion coating including at least one of chromium phosphate, black iron oxide, or nickel phosphate; and a zinc coating between the at least one elongated steel tension member and the conversion coating.

24. The load bearing member as recited in claim 23, wherein the conversion coating includes chromium phosphate.

25. The load bearing member as recited in claim 23, wherein the conversion coating includes black iron oxide.

26. The load bearing member as recited in claim 23, wherein the conversion coating includes nickel phosphate.

27. The load bearing member as recited in claim 23, including a polymer jacket at least partially surrounding the elongated steel tension member.

* * * * *